US006851358B2

(12) United States Patent
Gawlitta et al.

(10) Patent No.: US 6,851,358 B2
(45) Date of Patent: Feb. 8, 2005

(54) FRAME FOR PANEL PRESS

(75) Inventors: Werner Gawlitta, Tegelen (NL); Klaus Schürmann, Jüchen (DE); Lothar Sebastian, Duisburg (DE); Horst Weiss, Krefeld (DE); Christoph Schmitz, Kerken (DE); Klaus Wollny, Krefeld (DE)

(73) Assignee: Siempelkamp Maschinen- und Anlagenbau GmbH & Co. KG, Krefeld (DE)

( * ) Notice: Subject to any disclaimer, the term of this patent is extended or adjusted under 35 U.S.C. 154(b) by 3 days.

(21) Appl. No.: 10/285,355

(22) Filed: Oct. 31, 2002

(65) Prior Publication Data

US 2003/0084795 A1 May 8, 2003

(30) Foreign Application Priority Data

Nov. 3, 2001 (DE) ..... 101 54 114
Sep. 3, 2002 (DE) ..... 102 41 119

(51) Int. Cl.[7] ..... B30B 1/00
(52) U.S. Cl. ..... 100/324; 100/194; 156/580
(58) Field of Search ..... 100/324, 325, 100/193, 194, 195, 214, 269.17; 156/580, 583.1; 425/338, 406, 407

(56) References Cited

U.S. PATENT DOCUMENTS 2,056,331 A * 10/1936 Shutt ..... 100/195
2,382,041 A * 8/1945 Ernst ..... 409/248
2,491,384 A * 12/1949 MacMillin et al. ..... 384/39
2,758,618 A * 8/1956 Bergvall et al. ..... 100/48
3,687,066 A * 8/1972 Von Platen et al. ..... 100/214
4,222,724 A * 9/1980 van Hullen ..... 425/141
5,611,271 A 3/1997 Bielfeldt
6,101,861 A * 8/2000 VanderZee et al. ..... 72/405.01

FOREIGN PATENT DOCUMENTS

DE 195 00 983 12/1995
DE 44 08 101 1/1997

* cited by examiner

*Primary Examiner*—Allen Ostrager
*Assistant Examiner*—Shelley Self
(74) *Attorney, Agent, or Firm*—Herbert Dubno; Andrew Wilford

(57) ABSTRACT

A panel press has horizontally spaced and vertically oriented window-type tension frames each in turn having an upper beam having opposite ends each formed with an upwardly directed seat, a lower beam beneath the upper beam and having opposite ends each formed with a downwardly directed seat, and respective vertical side elements extending between the ends of the upper and lower beams and each unitarily formed with a laterally projecting upper end having a downwardly directed surface bearing downward on the respective upper-beam seat and with a laterally projecting lower end having an upwardly directed surface bearing upward on the respective lower-beam seat. Vertical bolts secure the laterally projecting ends to the respective beam ends.

20 Claims, 9 Drawing Sheets

FRAME FOR PANEL PRESS

FIELD OF THE INVENTION

The present invention relates to a single- or multi-stage panel press. More particularly this invention concerns a frame for such a press.

BACKGROUND OF THE INVENTION

A standard single- or multistage panel press used for instance to manufacture plywood, particleboard, or flakeboard has a housing formed by a plurality of annular and rectangular tension frames lying in respective horizontally spaced vertical planes. Each tension frame has a horizontal lower element or beam, a horizontal upper element or beam, and a pair of vertical and horizontally spaced side elements each having an upper end secured to the respective upper beam and a lower end secured to the respective lower beam so as to form a window. The frames support a pair of vertically spaced horizontal platens one of which can be moved vertically toward the other, typically by a heavy-duty hydraulic actuator. One or more workpiece panels carried on respective plates or belts are positioned in the plurality of frames between the platens and the one platen is urged toward the other to compress the workpiece or workpieces, so as to compact them and cure a binder in them.

In U.S. Pat. No. 5,611,271 of F. Bielfeldt a window-type tension frame of the above-described type is described for a multistage press. Each of the vertical frame elements is secured to the upper and lower beams by complex joints held together by vertical tie screws. Special brackets are provided to anchor these screws, so that construction is complex and expensive. Furthermore servicing such a press is difficult in that the steps to disassemble and reassembly a single window-type frame are quite extensive.

Another system described in German patent 19,500,983 published 21 Dec. 1995 uses a simpler brute-force approach in that the side elements and beams have lateral flanges that are bolted together. Thus these attachment bolts carry all the load. Such an arrangement is bulky and, once again, entails complex construction at the locations where the vertical side elements, which are stressed virtually only in tension, are connected to the upper and lower beams.

OBJECTS OF THE INVENTION

It is therefore an object of the present invention to provide an improved tension frame for a panel press.

Another object is the provision of such an improved tension frame for a panel press which overcomes the above-given disadvantages, that is which is of simple but very robust construction.

SUMMARY OF THE INVENTION

A panel press has a plurality of horizontally spaced and vertically oriented window-type tension frames each in turn having an upper beam having opposite ends each formed with an upwardly directed seat, a lower beam beneath the upper beam and having opposite ends each formed with a downwardly directed seat, and respective vertical side elements extending between the ends of the upper and lower beams and each unitarily formed with a laterally projecting upper end having a downwardly directed surface bearing downward on the respective upper-beam seat and with a laterally projecting lower end having an upwardly directed surface bearing upward on the respective lower-beam seat.

Respective vertical bolts secure the laterally projecting ends to the respective beam ends.

This fairly simple construction creates a structure of high strength, making the press housing extremely rigid. The, primary stress is tension and it is not carried by fasteners at trouble-prone joints, but instead is transmitted directly from structural member to structural member by direct load-bearing engagement. There is no shear or tension applied primarily to a fastener.

Each of the side-element upper ends can be formed with a horizontally extending hole having an upper surface bearing downward on the respective upwardly directed upper-beam surface and each of the side-element lower ends is similarly formed with a horizontally extending hole having a lower surface bearing on the respective downwardly directed lower-beam surface. This mortise/tenon type of interconnection is also capable of bearing an enormous load.

In a particularly advantageous system, each of the upper beams is comprised of a pair of horizontally adjacent upper-beam members forming a pair of horizontally oppositely open notches receiving the upper ends of the respective side elements and each of the lower beams is comprised of a pair of horizontally adjacent lower-beam members forming a pair of horizontally oppositely open notches receiving the lower ends of the respective side elements. Here each side-element end is hammer-shaped. Thus the hammer heads are fitted to the notches so that the bolts serve principally to maintain the parts in position, but do not actually carry any of the tension load created in the side elements during a printing cycle.

Each of the side elements can be formed by a pair of substantially identical bars having flat inner sides bearing flatly against each other and outer sides from which the ends project laterally.

According to the invention a plurality of horizontal tie rods are engaged through the beams, and a plurality of spacers are engaged between the beams and hold the beams horizontally apart. These spacers are sleeves surrounding the tie rods between the beams. The tie rods engage through the beams between the ends thereof and may also engage through the side elements. Compensation plates can be engaged between the side elements and the rods. These compensation plates are elastically deformed between the side elements and rods and serve to rigidify the press housing.

The frames according to the invention are arranged in spaced pairs, but they are single at ends of the press. In addition the side elements can be joined together at their laterally projecting ends above and below the ends of the beams. Each of the elements in this system has welded-on reinforcement plates at the respective ends. Furthermore each of the beam seats can be formed by a floor of a vertically open recess complementary to the respective laterally projecting side-element end. Thus the side-element ends are solidly seated in the beam ends.

BRIEF DESCRIPTION OF THE DRAWING

The above and other objects, features, and advantages will become more readily apparent from the following description, it being understood that any feature described with reference to one embodiment of the invention can be used where possible with any other embodiment and that reference numerals or letters not specifically mentioned with reference to one figure but identical to those of another refer to structure that is functionally if not structurally identical. In the accompanying drawing.

SPECIFIC DESCRIPTION

Figure 1:
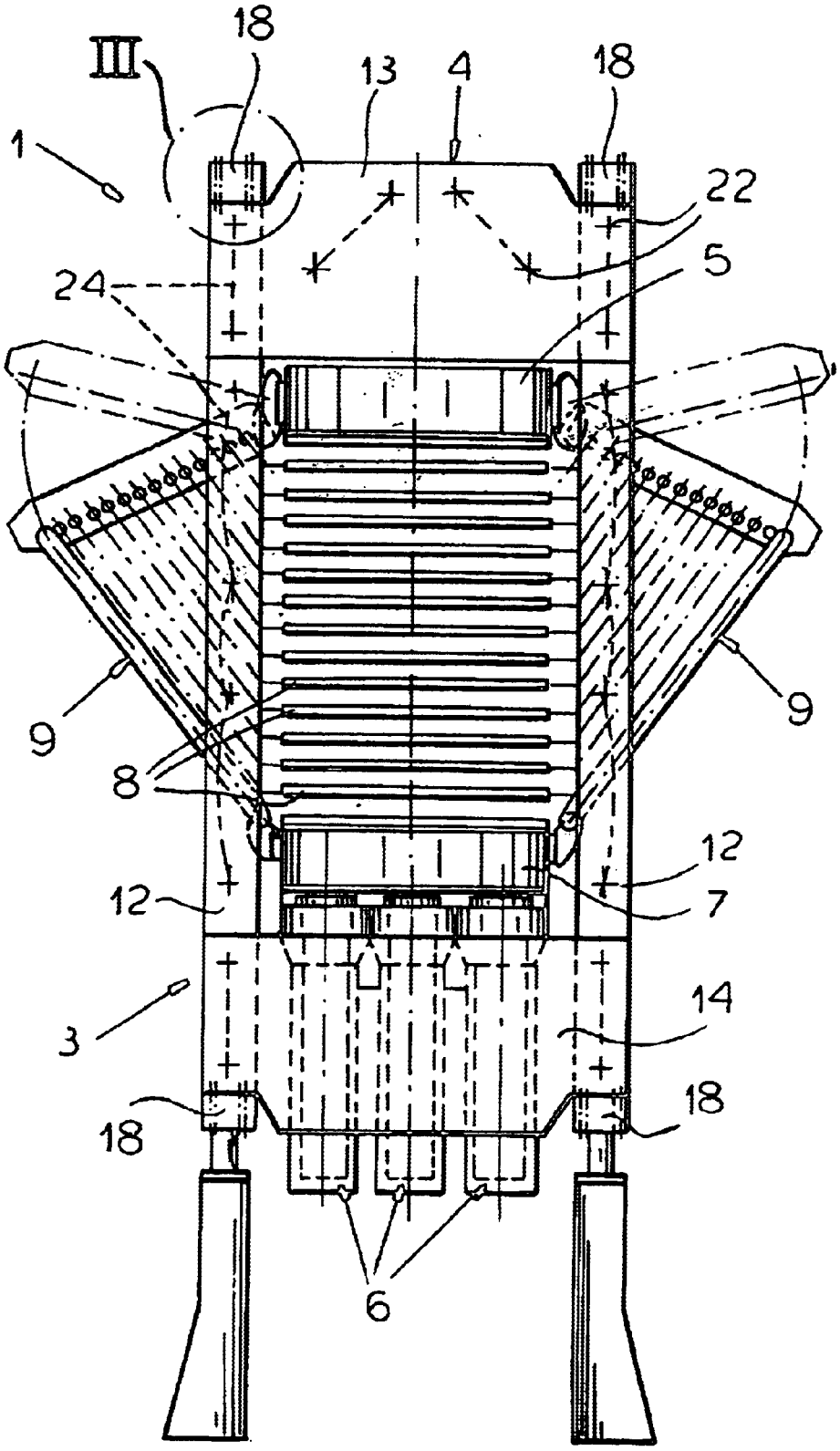
FIG. 1 is an end view of a multistage press according to the invention.
Figure 2:
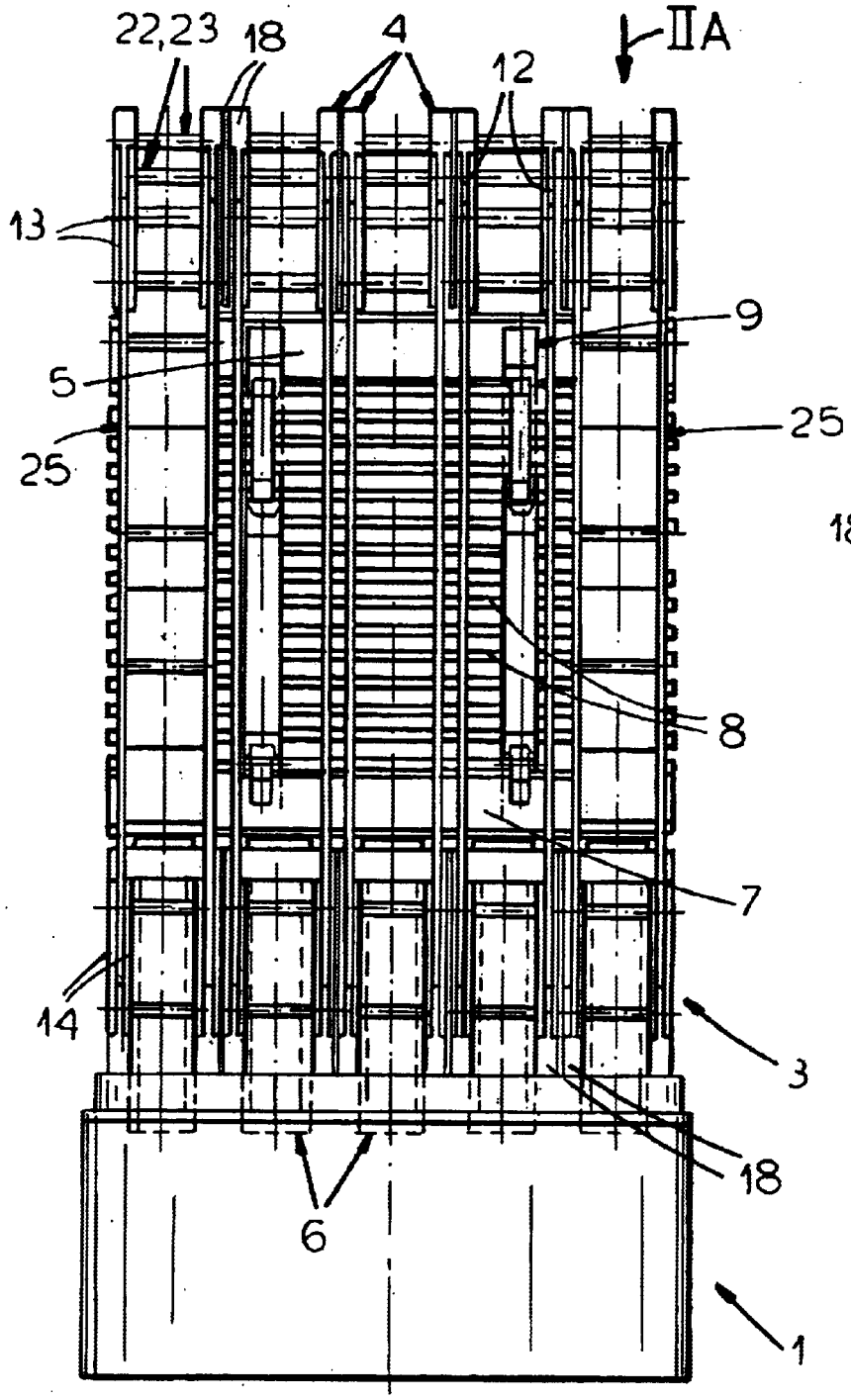
FIG. 2 is a side view of the press of FIG. 1.
Figure 2A:
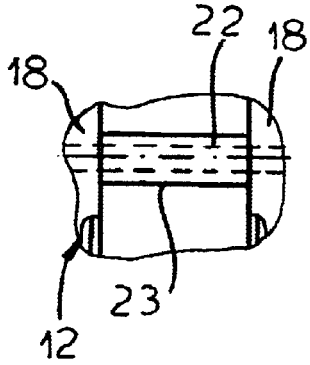
FIG. 2A is a large-scale view of the detail indicated at IIA in FIG. 2.

FIGS. 1 and 2 show a multistage panel press 1 and FIGS. 8 through 11 a single-stage press 2 which serve to press multiple or single workpiece panels into particleboard, plywood, or the like. The presses 1 and 2 both have a housing 3 formed of a row of vertically oriented window-type tension frames 4 which are the focus of the instant invention. Each frame 4 basically comprises an upper beam 13, a lower beam 14, and a pair of side elements 12, all formed of high-strength sheet steel. The multi-stage press 1 (FIGS. 1 and 2) has a stationary upper platen 5, a lower platen 7 that is vertically movable by an array of horizontal actuators 6, and a plurality of workpiece-support plates 8 situated between the platens 5 and 7 and carried by a simultaneous-closing device 9 of standard configuration. The single-stage press 2 (FIGS. 8 through 11) has a stationary lower platen 10 and a vertically displaceable upper platen 11.

The frames 4 must resist enormous forces tending to spread the upper and lower beams 13 and 14. To this end in both of the presses 1 and 2 the upper beams 13 and lower beams 14 are provided in pairs, with the respective side elements 12 each being sandwiched between outer ends of a pair of the upper beams 13 and a pair of the lower beams 14, in effect fitted to a notch formed at the outer end of each pair of upper beams 13 and lower beams 14. Each element 12 has at its upper end and its lower end a hammer head 18 projecting laterally in opposite directions.

Figure 3:
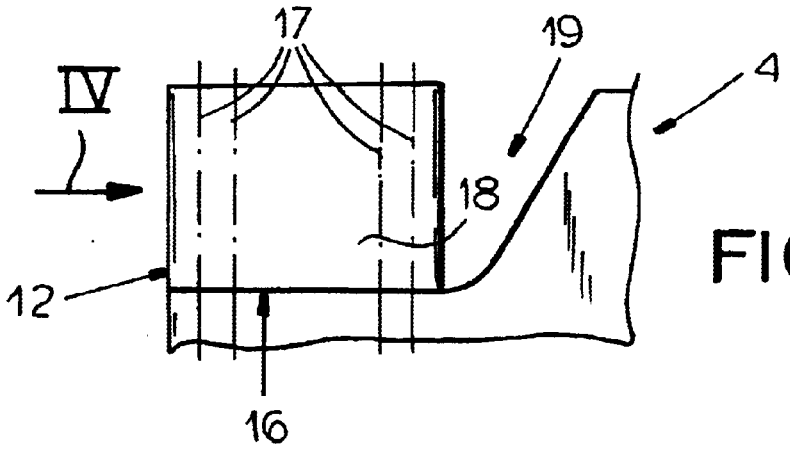
FIG. 3 is a large-scale view of the detail indicated at III in FIG. 1.
Figure 4:
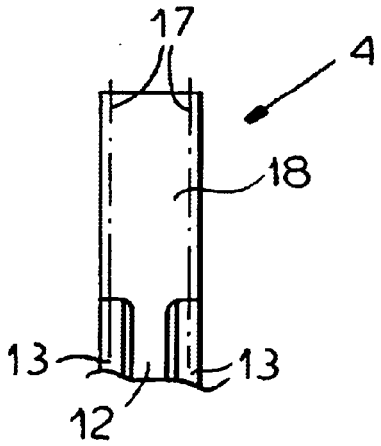
FIG. 4 is a side view taken in the direction of arrow IV of FIG. 3.
Figure 5:
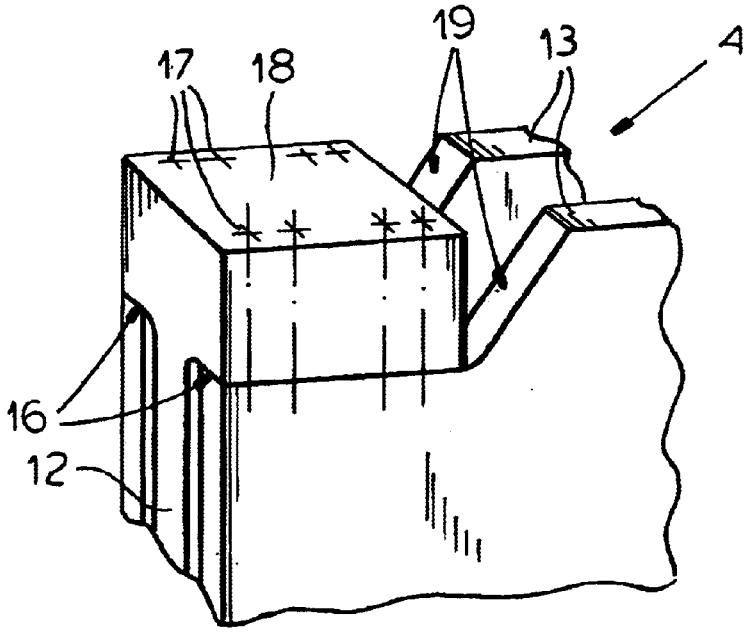
FIG. 5 is a perspective view of the detail shown in FIGS. 3 and 4.

FIGS. 3 and 4 show an end of such a double upper beam 13 which is formed with seats 19 having upwardly directed surfaces 16 on which the head 18 sits. Vertical machine screws 17 passing through the heads 18 are threaded into the beams 13 to lock the assembly together. The hammer heads 18 of the lower ends of the side elements 12 similarly engage upward against downwardly directed seat surfaces of the paired lower beams 14 and are secured thereto by similar screws 17. The side elements 12 are paired, as are the upper and lower beams 13 and 14, except as indicated at 25 at the ends of the presses 1 and 2 (see FIG. 2).

The horizontal spacing between adjacent frames 4 is set by horizontal tie rods or bolts 22 passing longitudinally through the entire frame 13, with spacer tubes 23 fitted to the rods 22 between adjacent frames 4. In each paired set of frames 4 the side elements 12 are held apart by spacers 15. The rods 22 are spaced and are engaged through the upper beams 13 and lower beams 14, and may also be engaged through the side elements 12 as shown. Compensation plates 24, which originally are of curved or V-shape, are fitted between the elements 12, in fact bent around the anchor bolts 22 so that they rigidify the press housing 3.

Figure 6:
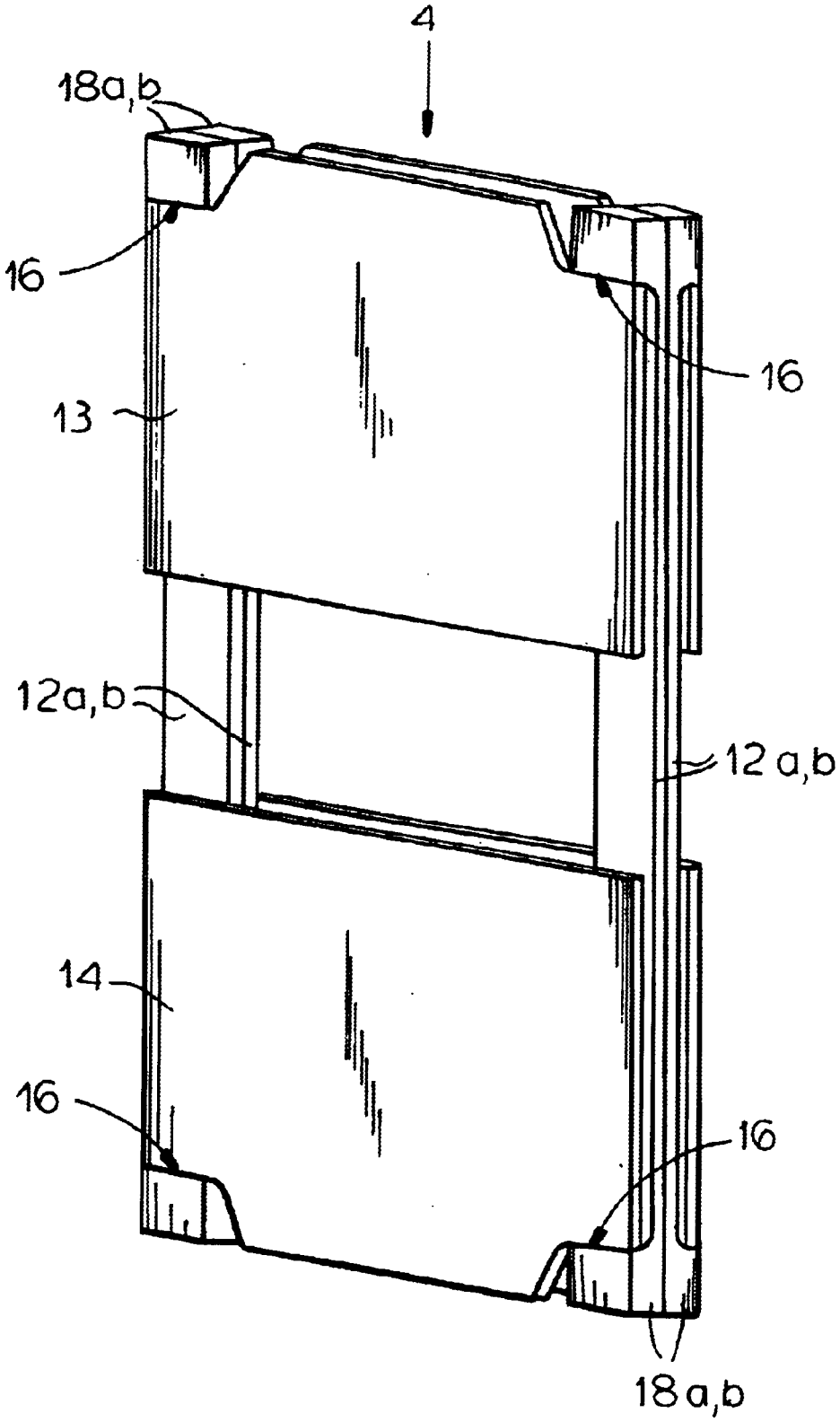
FIG. 6 is a perspective view of an alternative window-type tension frame in accordance with the invention.

FIG. 6 shows how the upper and lower beams 13 and 14 are formed as wide steel plates. In addition here each of the side elements is formed by a pair of identical side-element bars 12*a* and 12*b* having flat planar sides that bear against each other and opposite side formed with protrusions 18*a* and 18*b* forming the hammer heads.

Figure 7:
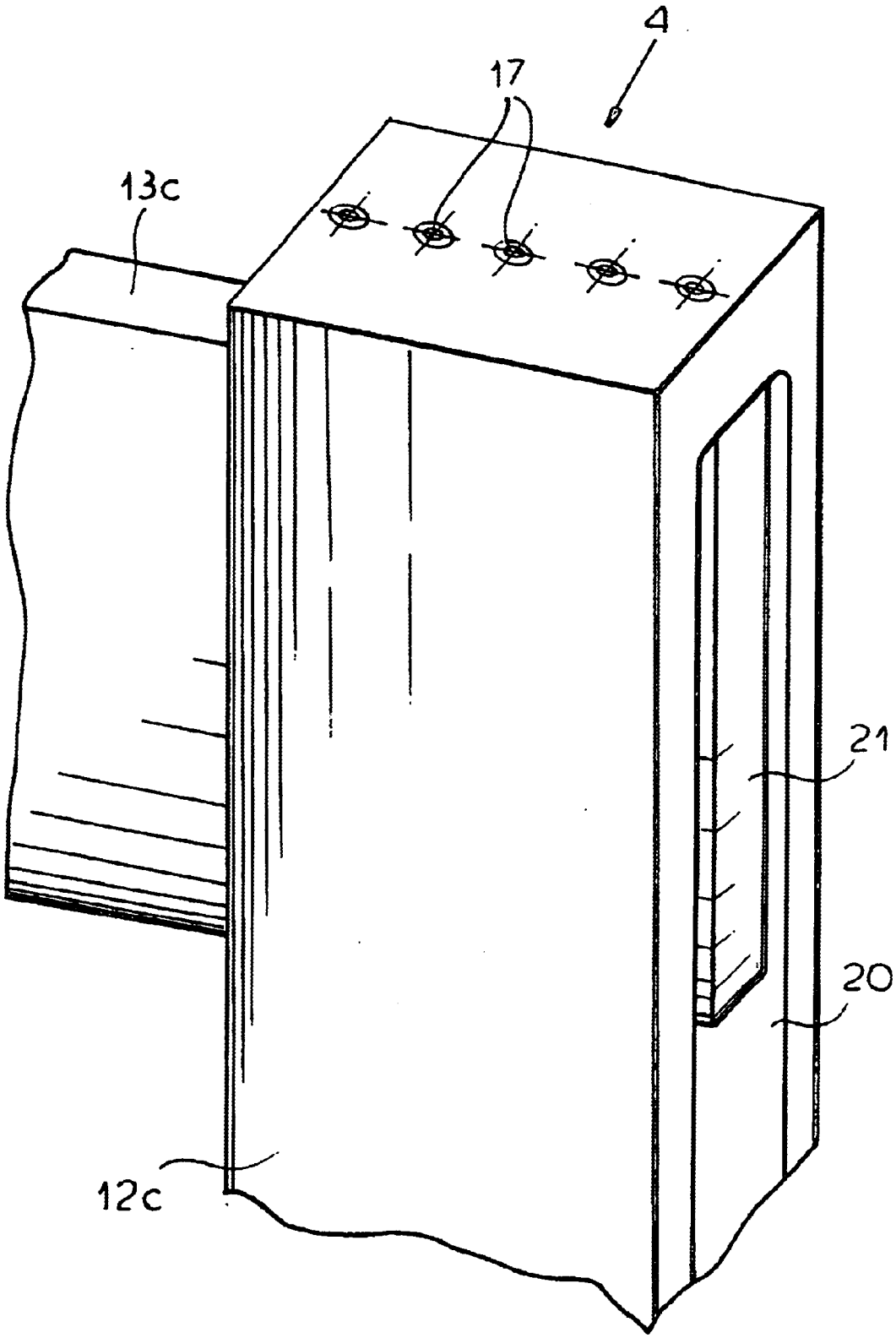
FIG. 7 is a large-scale view of another variant on the tension frame of this invention for the press of FIGS. 1 and 2.
Figure 8:
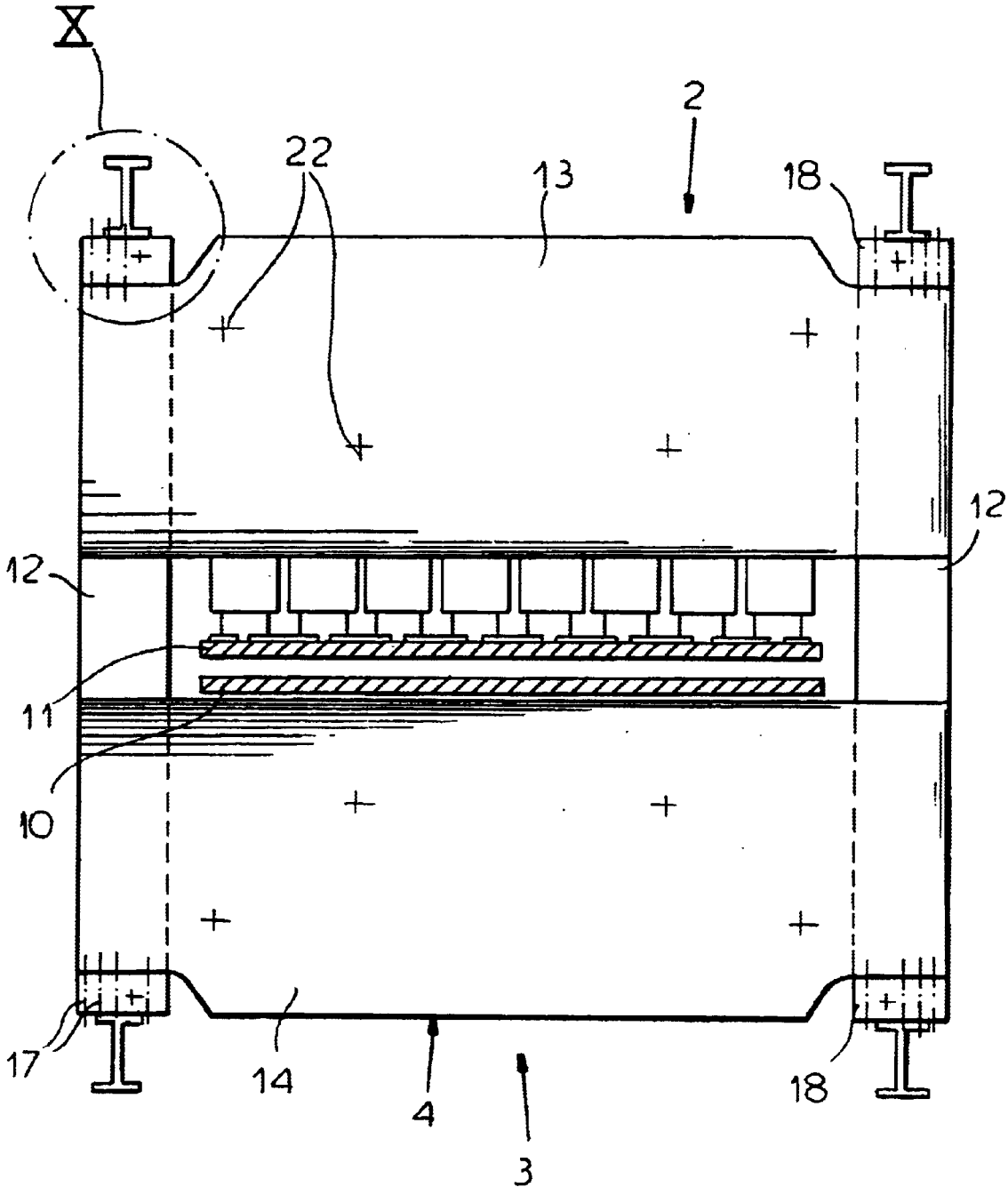
FIG. 8 is an end view of a single-stage press according to the invention.
Figure 9:
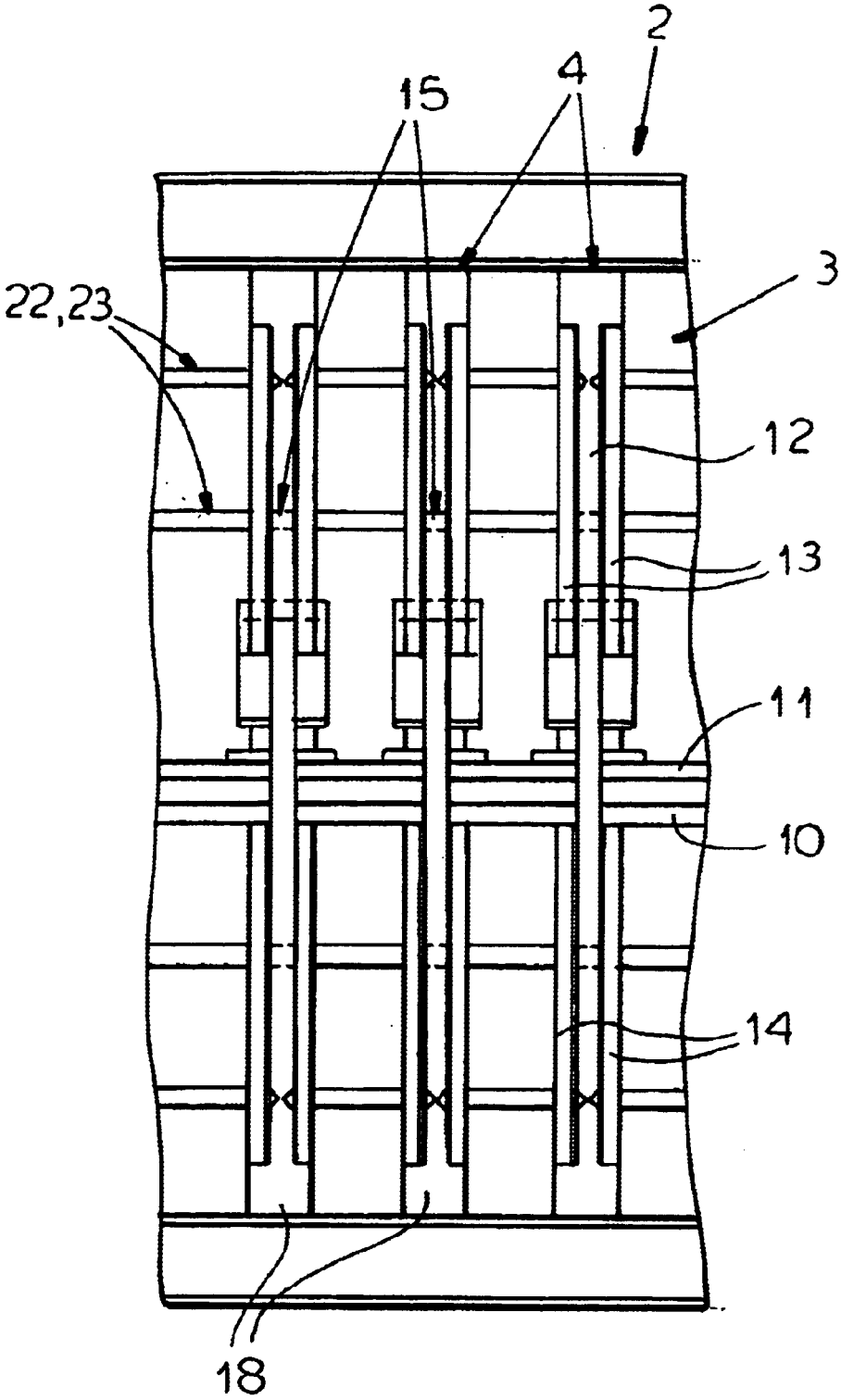
FIG. 9 is a side view of a detail of the single-stage press of FIG. 8.
Figure 10:
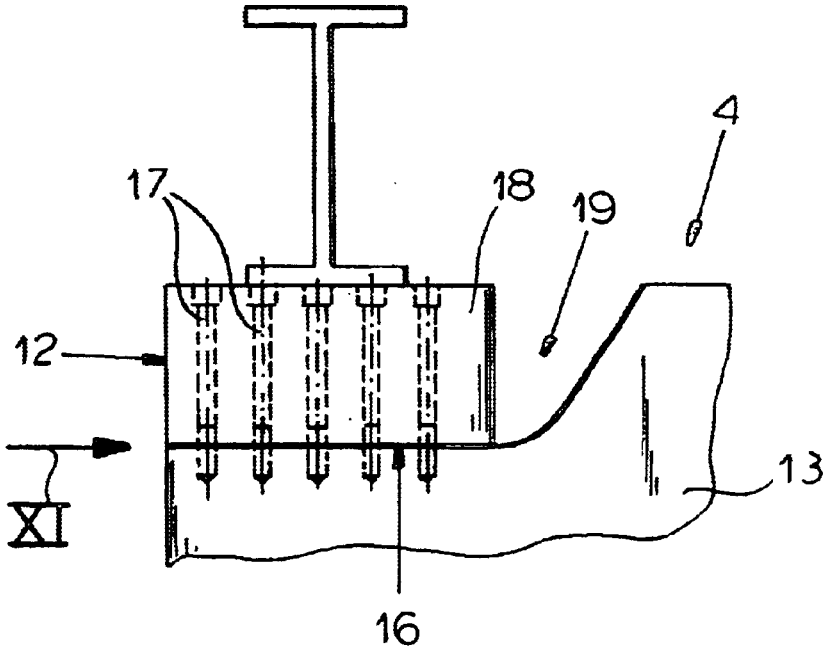
FIG. 10 is a large-scale view of the detail indicated at X in FIG. 8.
Figure 11:
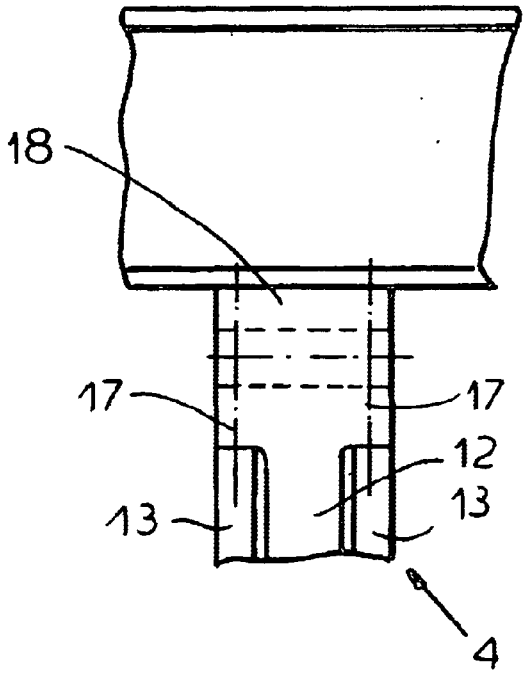
FIG. 11 is a side view taken in the direction of arrow XI of FIG. 10.

In FIG. 7 a beam 13*c* projects as a tenon 21 into a horizontally open hole or slot 20 formed in the side element 12*c*. Thus a downwardly directed upper face of the slot 20 bears downward on an upwardly directed upper face of the beam 13*c*. The lower end of the element 12*c* fits similarly with the lower beam.

Figure 12:
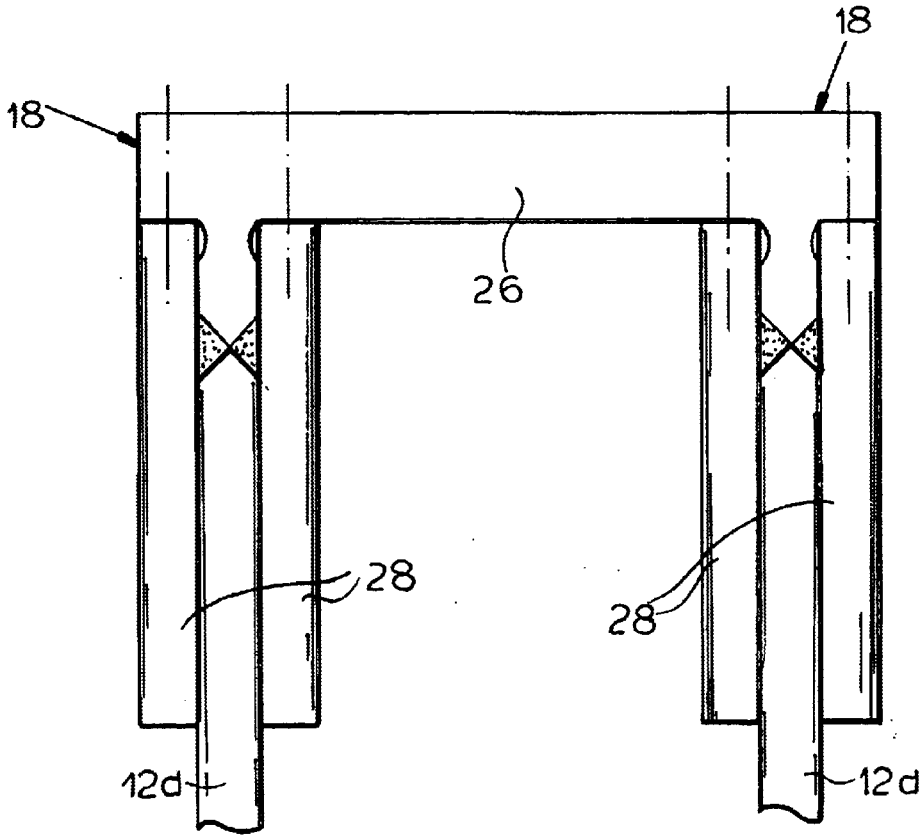
FIG. 12 is a side view of a detail of another variant on the present invention.

The beams 12*d* of FIG. 12 have hammer heads 18 that are joined together longitudinally of the press by a bar 26 that is actually unitary with these heads 18. Plates 28 welded to the sides of the elements 12*d* secure these heads 18 and the unitary bar 26 in position.

Figure 13:
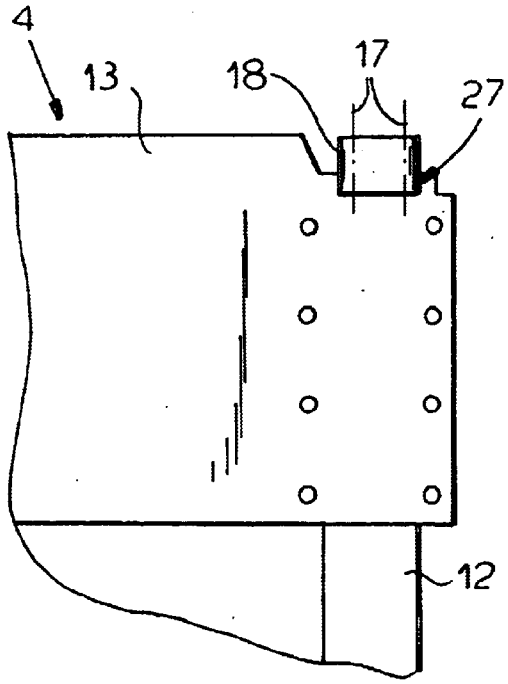
FIG. 13 is an end view of a detail of yet another variant on the press of this invention.

FIG. 13 shows how the beam 13 can be formed with an upwardly open rectangular-section seat or recess 27 into which the hammer head 18 fits complementarily.

We claim:

1. In a panel press having a plurality of horizontally spaced and vertically oriented window-type tension frames, the improvement wherein each of the frames comprises:

an upper beam having opposite ends each formed with an upwardly directed seat;

a lower beam beneath the upper beam and having opposite ends each formed with a downwardly directed seat;

respective vertical side elements extending between the ends of the upper and lower beams and each unitarily formed with a laterally projecting upper end having a downwardly directed surface bearing downward on the respective upper-beam seat and with a laterally projecting lower end having an upwardly directed surface bearing upward on the respective lower-beam seat;

respective vertical bolts securing the laterally projecting ends to the respective beam ends;

a plurality of horizontal tie rods engaged through the beams; and a plurality of spacers engaged between the beams and holding the beams horizontally apart.

2. The panel press defined in claim 1 wherein each of the side-element upper ends is formed with a horizontally extending hole having an upper surface bearing downward on the respective upwardly directed upper-beam surface and each of the side-element lower ends is similarly formed with a horizontally extending hole having a lower surface bearing on the respective downwardly directed lower-beam surface.

3. The panel press defined in claim 1 wherein each of the upper beams is comprised of a pair of horizontally adjacent upper-beam members forming a pair of horizontally oppositely open notches receiving the upper ends of the respective side elements and each of the lower beams is comprised of a pair of horizontally adjacent lower-beam members forming a pair of horizontally oppositely open notches receiving the lower ends of the respective side elements, each side-element end being hammer-shaped.

4. The panel press defined in claim 3 wherein each of the side elements is formed by a pair of substantially identical bars having flat inner sides bearing flatly against each other and outer sides from which the ends project laterally.

5. The panel press defined in claim 1 wherein the spacers are sleeves surrounding the tie rods between the beams.

6. The panel press defined in claim 1 wherein the tie rods engage through the beams between the ends thereof.

7. The panel press defined in claim 1 wherein the rods engage through the side elements, the press further comprising:

compensation plates engaged between the side elements and the rods.

8. The panel press defined in claim 7 wherein the compensation plates are elastically deformed between the side elements and rods.

9. The panel press defined in claim 1 wherein the frames are arranged in spaced pairs.

10. The panel press defined in claim 9 wherein the frames are single at ends of the press.

11. The panel press defined in claim 1 wherein the side elements are joined together at their laterally projecting ends above and below the ends of the beams.

12. The panel press defined in claim 11 wherein each of the elements has welded-on reinforcement plates at the respective ends.

13. The panel press defined in claim 1 wherein each of the beam seats is formed by a floor of a vertically open recess complementary to the respective laterally projecting side-element end.

14. In a panel press having a plurality of horizontally spaced and vertically oriented window-type tension frames, the improvement wherein each of the frames comprises:

a pair of horizontally adjacent upper beams each having opposite ends each formed with an upwardly directed seat, the upper-beam ends of each pair forming at each end a horizontally outwardly open upper notch;

a pair of horizontally adjacent lower beams beneath the upper beam and each having opposite ends each formed with a downwardly directed seat, the lower-beam ends of each pair forming at each end a horizontally outwardly open lower notch;

respective vertical hammer-shaped side elements extending between the ends of the upper and lower beams and each unitarily formed with laterally projecting upper ends seated in the upper beam notches and having downwardly directed surfaces bearing downward on the respective upper-beam seats and with laterally projecting lower ends seated in the lower-beam notches and having upwardly directed surfaces bearing upward on the respective lower-beam seats; and respective vertical bolts securing the laterally projecting ends to the respective beam ends.

15. The panel press defined in claim 14 wherein each of the side elements is formed by a pair of substantially identical bars having flat inner sides bearing flatly against each other and outer sides from which the ends project laterally.

16. The panel press defined in claim 14 wherein the frames are arranged in spaced pairs.

17. The panel press defined in claim 16 wherein the frames are single at ends of the press.

18. The panel press defined in claim 14 wherein the side elements are joined together at their laterally projecting ends above and below the ends of the beams.

19. The panel press defined in claim 18 wherein each of the elements has welded-on reinforcement plates at the respective ends.

20. The panel press defined in claim 14 wherein each of the beam seats is formed by a floor of a vertically open recess complementary to the respective laterally projecting side-element end.

* * * * *